US009719180B2

(12) United States Patent
Massaro et al.

(10) Patent No.: US 9,719,180 B2
(45) Date of Patent: Aug. 1, 2017

(54) DOSE METER FOR CRUST PUNCH AND ALUMINA DISPENSER

(71) Applicants: Lucille A. Massaro, Syracuse, NY (US); Michael F. Carno, Syracuse, NY (US)

(72) Inventors: Peter C. Massaro, Syracuse, NY (US); Michael F. Carno, Baldwinsville, NY (US)

(73) Assignee: Control Automation, LLC, Syracuse, NY (US)

( * ) Notice: Subject to any disclaimer, the term of this patent is extended or adjusted under 35 U.S.C. 154(b) by 284 days.

(21) Appl. No.: 14/568,224

(22) Filed: Dec. 12, 2014

(65) Prior Publication Data

US 2015/0167190 A1 Jun. 18, 2015

Related U.S. Application Data

(60) Provisional application No. 61/917,118, filed on Dec. 17, 2013.

(51) Int. Cl.
*C25C 7/00* (2006.01)
*C25C 3/14* (2006.01)

(52) U.S. Cl.
CPC . *C25C 7/00* (2013.01); *C25C 3/14* (2013.01)

(58) Field of Classification Search
CPC ..... C25C 3/14; C25C 7/00
USPC ..... 266/44, 216, 271, 90, 287; 222/591; 75/684; 205/230, 392; 204/245
See application file for complete search history.

(56) References Cited

U.S. PATENT DOCUMENTS 4,431,491 A * 2/1984 Bonny ..... C25C 3/20 204/245
5,423,968 A * 6/1995 Kissane ..... C25C 3/14 204/245
7,892,319 B2 * 2/2011 Massaro ..... C25C 3/14 266/216

* cited by examiner

*Primary Examiner* — Scott Kastler
*Assistant Examiner* — Michael Aboagye
(74) *Attorney, Agent, or Firm* — Bernhard P. Molldrem, Jr.

(57) ABSTRACT

A crust breaker and ore feeder device for electrolytic aluminum smelting employs an in-line three-position pneumatic cylinder capable of moving the plunger shaft between a raised position and a fully lowered position. A dose meter in the form of a cylindrical member rests a small distance above the valve seat of the crust breaker. In the raised position the dose meter fits within the dosing cup and receives the dose of alumina. In the lowered position of the crust breaker, the dose meter slows down the flow of alumina into the electrolytic liquid, with the alumina flowing out through cutouts formed in the lower rim of the dose meter.

6 Claims, 2 Drawing Sheets

DOSE METER FOR CRUST PUNCH AND ALUMINA DISPENSER

This patent application claims priority under 35 U.S.C. 119(e) of provisional patent application Ser. No. 61/917,118, filed Dec. 17, 2013.

BACKGROUND OF THE INVENTION

The invention is directed to a device used in the refining of aluminum, i.e., smelting, in which a pneumatically driven hammer is employed for punching through the crust that develops on top of the molten refined aluminum-electrolyte, and there is an alumina dispenser cup or chamber that fills with alumina (typically comminuted into a powder form) and then the cup dispenses the alumina when the hammer is driven downward. A suitable crust punch and alumina dispenser device is described in our prior U.S. Pat. No. 7,892,319, granted Feb. 22, 2011.

In this improvement, a generally cylindrical-shaped dose meter or alumina flow limiter is positioned onto the shaft of the crust breaker within the space of the dispenser cup and just above the valve seat. The alumina dust fills the cup when the crust breaker shaft is raised, and then when the crust breaker descends the valve seat pulls away from the lower rim of the cup and the alumina then pours out onto the molten material in the aluminum smelting pot. The objective of the dose meter is to slow down the flow of the alumina powder so that it is not dumped in all at once, but flows out over a period of several seconds. To that end, the cylinder-shaped dose meter is spaced a short distance above the top surface of the valve seat and there are also a number of cutouts in the lower rim of the dose meter. This ensures that the entire dose will flow out, and the space between the dose meter and the valve seat flows the material out so that the alumina material does not clog behind the dose meter. The dose meter ensures a more regulated rate of flow of the alumina powder.

The flow-regulating or flow-limiting device can take the form of a generally cylindrical sleeve that fits inside the cup or dose holder and may optionally have a small stand-off between the bottom edge and the valve cone, and also may have notches or cutouts in the lower edge, so that when the cup is opened, the aluminum ore flows in a slower stream instead of being dumped in suddenly into the molten electrolyte in the aluminum smelting pot. Favorably, the dose meter is to be used with a combination crust breaking and alumina feeding device, capable of both dosing and crust breaking, or dosing alone or crust breaking alone. Embodiments of the dose meter can be in the form of two identical halves that bolt together on the chisel shaft above the valve seat, with notches cut out of the bottom edge, and possibly with feet or standoffs to keep the lower edge of the dose meter a small distance above the valve seat. Other embodiments may be formed of three, four, or more components that bolt or fasten together about the chisel shaft.

The combination crust breaker and ore feeder or dispenser can be of the type described in our earlier U.S. Pat. No. 7,892,319, which is incorporated herein by reference, or for example in U.S. patents to Kissane, U.S. Pat. No. 5,423,968 or U.S. Pat. No. 5,324,408.

DETAILED DESCRIPTION

Figure 1:
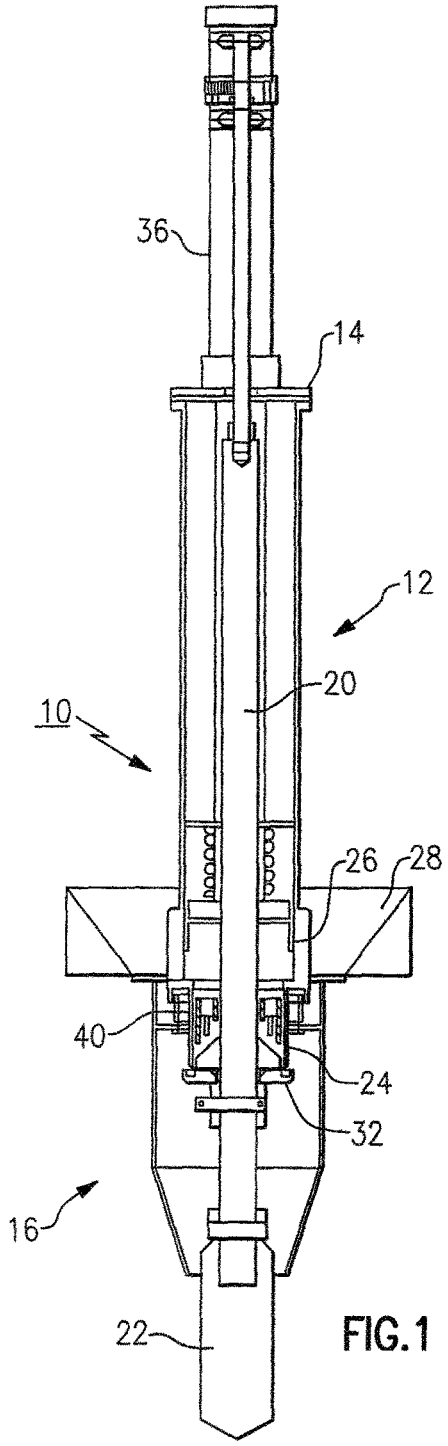
FIGS. 1 and 2 are sectional drawing views of a crust breaker and ore feeder device according to the prior art, with FIG. 1 showing the crust breaker and ore feeder device in the raised position, in which the cup or dispenser fills with alumina powder, and with FIG. 2 showing the device in the lowered or descended position, in which the crust breaker hammer is driven downward and the valve seat portion of the cup is opened to allow the alumina powder to fall down into the electrolyte in the smelting pot.
Figure 2:
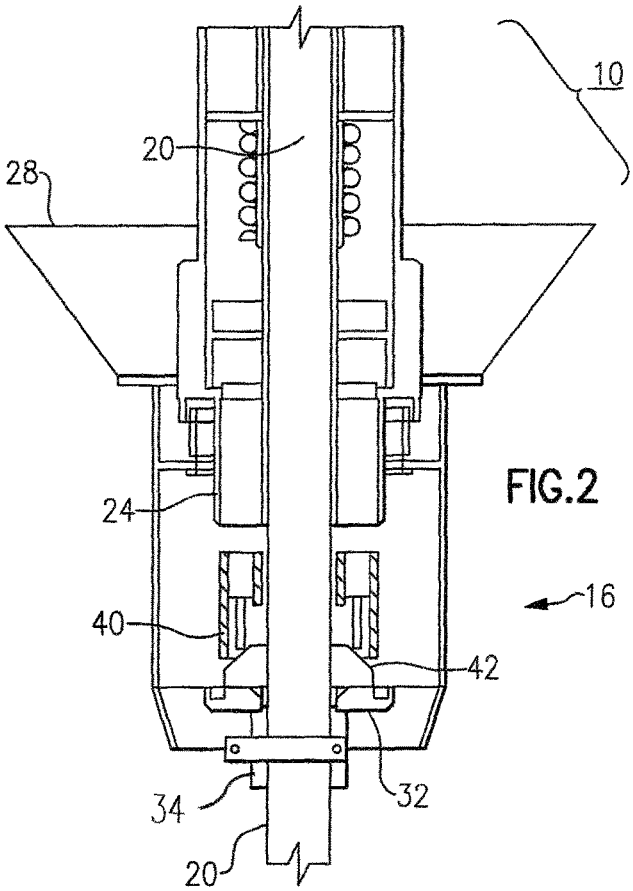
Figure 3:
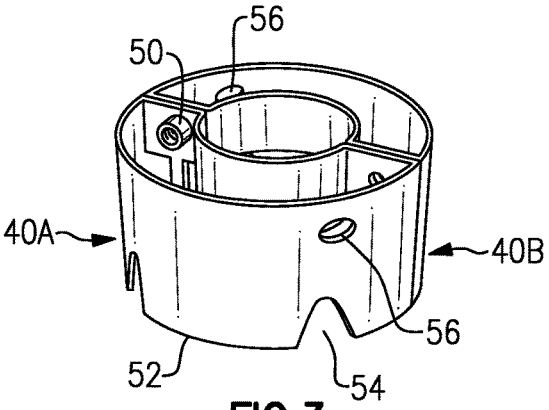
FIGS. 3 and 4 are perspective views of the dose meter according to one embodiment of the invention.
Figure 4:
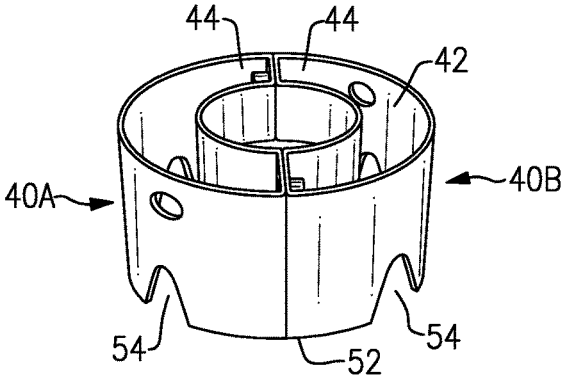
Figure 5:
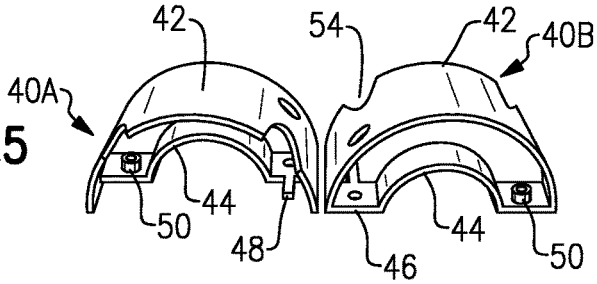
FIG. 5 is a perspective view of the two halves of the dose meter, showing the outer surface of the outer half cylinder walls.
Figure 6:
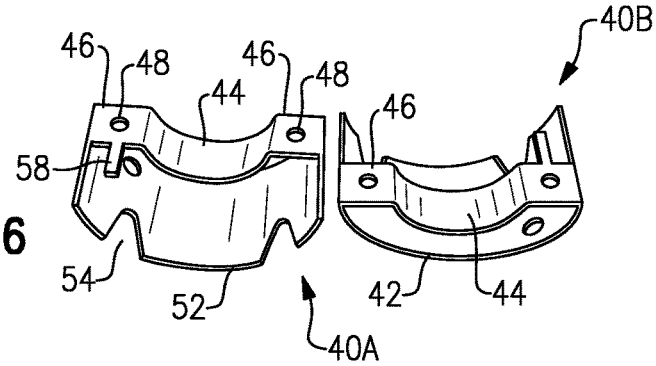
FIG. 6 is another perspective view of the two halves thereof, showing the inner surfaces of the inner half rings, and also illustrating the connecting flanges, bolt holes and spacer finger.
Figure 7:
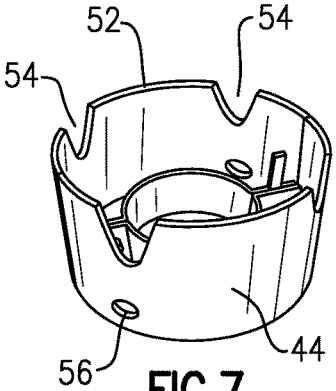
FIG. 7 is an inverted perspective view thereof, showing the notches or cutouts in the bottom edge thereof.
Figure 8:
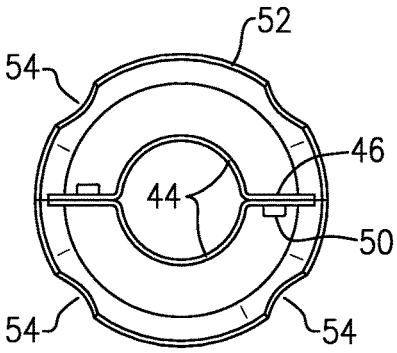
FIG. 8 it a bottom plan thereof.

With reference to the Drawing, and initially to FIGS. 1 and 2, a typical ore feeder and crust breaker arrangement 10 is shown in FIG. 1, here in its raised position. The feeder portion thereof in its lowered or open position (for dispensing ore) is shown in FIG. 2. The feeder and crust breaker assembly 10 is positioned on the top wall or cover of an aluminum smelting pot, not shown, above the molten electrolyte. The assembly 10 has an elongated cylindrical housing 12, with a mounting flange 14 at its top. The housing 12 fits within a round opening provided in the top cover of the pot. There is a tapered lower end 16 that is intended to confine the distribution of the alumina so that it is dispensed near the opening that is created in the top crust layer.

A plunger shaft 20 extends along the vertical axis of the assembly 10 and is adapted for vertical motion along that axis. There is a chisel or hammer 22 mounted at the lower end of the shaft 20, and this chisel is adapted to break through the crust on the electrolyte upper surface to create an opening to admit the alumina powder into the molten liquid. In the electrolytic refining process, a surface coating of contaminates can develop on the chisel 22, and its presence within the electrolyte can sometime produce adverse electrical effects within the molten electrolyte.

A dose holder or cup 24 is located above the plunger chisel 22 within the housing. The dose holder 24 is typically of a cylindrical shape with an open upper end to receive the alumina powder and an open lower end for dispensing the powder. There is a cylindrical gate 26 that moves upward and downward, relative to the cup 24, to admit the ore powder into the cup and to close off the cup, respectively. A supply of alumina powder is contained within a hopper 28, and this alumina proceeds through apertures or ports in the housing 12 to the dose holder 24. A valve seat 32 is positioned on the shaft 20 at the lower end of the cup or dose holder 24. This valve seat 32 moves down when the shaft descends to open the dispenser cup and allow the alumina powder to fall from the cup and out the lower end of the housing. When the shaft ascends to its raised position, the valve seat 32 closes off the cup 24, and the gate 26 opens to admit the next measured dose of alumina powder. The valve seat 32 is slidable on the shaft 20, and a sleeve 34 on the shaft supports the valve seat 32 from below, so that the seat 32 moves downward a small distance when the shaft descends, and returns back to the closed position when the shaft 20 is fully raised.

An air cylinder 36 is disposed within the upper part of the housing 12. This cylinder 36 has a piston and rod, not shown, with the rod being connected to an upper end of the shaft 20. The cylinder may be a two-position cylinder or three-position cylinder, with upper and lower air ports and with air supply lines for driving the shaft 20 and chisel 22 downwards, i.e. to a fully extended position, when air is supplied, and for raising the shaft and chisel back to their elevated position. There is a pneumatic control (not shown) for controlling the application of compressed air to the respective supply lines. Typically, the pneumatic control is located at some distance from the feeder and crust breaker assembly, which necessitates having numerous air lines extending above the pot cover to reach each feeder and crust breaker assembly for that pot.

A generally cylindrical dose meter 40 is positioned over the chisel shaft 20 and may optionally rest on a cone-shaped inner portion 42 of the valve seat. This dose meter 40 is adapted to moderate the flow of alumina powder when the valve seat 32 opens, so that there is an extended moderate flow of the ore instead of a sudden drop of the entire dose onto the electrolyte.

This dose meter 40 is positioned within the cup 24 when the chisel and valve seat 32 are in the raised position (FIG. 1), and descends with the valve seat 32 when the shaft and valve seat moves to the open or lowered position as shown in FIG. 2.

The construction of the dose meter 40 of this embodiment is illustrated in FIGS. 3 to 8.

Dose meter 40 is formed of two identical halves 40A and 40B as shown in FIGS. 3, 4, 5 and 6, which fit together around the shaft 20. Each half is formed of steel, with an outer semi-cylinder 42 of a nominal outside diameter of 4¾ inches, an inner coaxial half-ring 44 of a nominal inside diameter of 2⅜ inches. Radial connecting flanges 46 join the ends of the outer semi-cylinder 42 to the ends of the inner half-ring 44. In this embodiment, the height of this dose meter 40 is about 2½ inches. The notches 54, discussed below, are about one inch wide and one inch in height. The notches can be V-shaped or U-shaped, or can be of a multitude of other patterns, e.g., holes, rectangular notches, etc.

The connecting flanges 46 have mating bolt holes 48 to receive a threaded connector (not shown) with one of the flanges also having an associated female-threaded nut 50 welded at the bolt hole 48. Access openings 56 are provided in the semi-cylinder for a screwdriver or other tool to tightening threaded fasteners in the bolt holes 48. These may be omitted in some embodiments if other fastening means are employed.

The outer semi-cylinders 42 each have a lower edge 52 and there are notches or cutouts 54 that extend up from the edge 52. The notches or cutouts 54 are somewhat V-shaped in this embodiment. In this example, one of the connecting flanges 46 of each half 40A, 40B has a finger or stand-off 58 that projects downward to rest upon the cone-shaped portion 42 of the valve seat 32. This creates a small gap or space between the lower edges 52 of the dose meter 40 and the valve seat 32 so that the alumina powder does not accumulate behind the semi-cylinder. However, the dose meter can be positioned on the shaft 20 offset from the dispersion cylinder 42 to allow for complete emptying of the alumina. This offset can be achieved via an offset due to the finger or stand-off 58 or via being attached at a set position above the dispersion cylinder. There may be a wide difference in the size and shape of the dispersement cone from one manufacturer to another.

When the shaft 20 and valve seat 32 of the dose holder or cup 24 is in the raised (FIG. 1) position, the cup 24 fills in the normal fashion with alumina powder from the hopper 28. Then, when the cylinder 36 is actuated to move the shaft 20 downward, and the valve seat descends to the open position (FIG. 2), the alumina dust flows out through the cutouts 54 and through the small gap between the lower edge 52 of the dose meter and the upper surface of the valve seat 32. This provides for a gentler, moderated flow of ore into the electrolyte, avoiding some of the problems that occur from the rapid dumping of ore that occurs without dose regulation.

In this embodiment, the dose meter is formed of two identical halves 40A and 40B. In other possible embodiments the dose meter could be formed, e.g., from three 120-degree segments or four 90-degree segments. The segments do not necessarily need to be identical. In still other possible embodiments the cutouts or notches 54 may be omitted with all the alumina escaping beneath the lower edge 52.

While this invention has been described in respect to one preferred embodiment, the invention is not limited only to that embodiment. Rather the scope of the invention is to be measured in terms of the appended Claims.

What is claimed is:

1. Dose meter for a dosing cup of a crust-breaker dispenser as employed in an aluminum smelting operation, comprising a generally cylindrical member dimensioned to fit within the dosing cup the cylindrical member having a generally arcuate lower rim with one or more cutouts extending above the rim;

a ring attaching around a shaft of the crust-breaker dispenser;

one or more connector flanges connecting said ring to said generally cylindrical member; and means for holding said generally cylindrical member in place a predetermined slot distance above a valve seat of the dosing cup as a stand-off to create a gap between a lower edge of said generally cylindrical member and said valve seat, the gap being of sufficient width to ensure that alumina does not accumulate between the generally cylindrical member and the valve seat, but narrow enough that most of the alumina passes out of the generally cylindrical member via said gap.

2. The dose meter of claim 1 wherein said generally cylindrical member includes a plurality of cutouts extending up from the lower edge thereof.

3. The dose meter of claim 1 wherein the generally cylindrical member is formed of two identical halves each including an outer semi-cylinder, an inner half ring, and a pair of radial connecting flanges that connect ends of the respective semi-cylinder to ends of the associated half ring.

4. The dose meter of claim 3 wherein said connecting flanges each have a bolt hole therethrough, one said bolt hole having a female thread and the other bolt hole being unthreaded.

5. The dose meter of claim 1 wherein the generally cylindrical member is formed of a plurality of sections, each such section extending over a sector of the cylinder of the generally cylindrical member, and each including an outer arcuate wall, an inner ring portion, and a pair of radial connecting flanges that connect ends of the arcuate wall to ends of the associated ring portion.

6. The dose meter of claim 1, further comprising one or more fingers that project downward from a portion of said generally cylindrical member to rest upon a portion of the valve seat of the dosing cup as a stand-off to create said gap between the lower edge of said generally cylindrical member and said valve seat.

* * * * *